US007959144B2

(12) United States Patent
Ramseier

(10) Patent No.: US 7,959,144 B2
(45) Date of Patent: Jun. 14, 2011

(54) MODULAR PROCESSING DEVICE AS WELL AS A CONSTRUCTION KIT FOR THE CONSTRUCTION OF SUCH A PROCESSING DEVICE

(75) Inventor: Marcel Ramseier, Wetzikon (CH)

(73) Assignee: FERAG AG, Hinwil (CH)

( * ) Notice: Subject to any disclaimer, the term of this patent is extended or adjusted under 35 U.S.C. 154(b) by 410 days.

(21) Appl. No.: 12/116,553

(22) Filed: May 7, 2008

(65) Prior Publication Data

US 2008/0277859 A1 Nov. 13, 2008

(30) Foreign Application Priority Data

May 11, 2007 (CH) ..... 769/07

(51) Int. Cl.
*B65H 5/30* (2006.01)

(52) U.S. Cl. ..... 270/52.3; 270/52.14; 270/52.16; 270/52.26; 270/52.29

(58) Field of Classification Search ..... 270/52.14, 270/52.16, 52.26, 52.29, 52.3
See application file for complete search history.

(56) References Cited

U.S. PATENT DOCUMENTS

| | | | | |
|---|---|---|---|---|
| 3,951,399 | A * | 4/1976 | Reist | 270/52.2 |
| 4,416,448 | A * | 11/1983 | Meier | 270/52.2 |
| 5,052,667 | A | 10/1991 | Hansch | |
| 5,324,014 | A * | 6/1994 | Honegger et al. | 270/52.3 |
| 5,657,978 | A * | 8/1997 | Meier et al. | 270/52.16 |

FOREIGN PATENT DOCUMENTS

| | | |
|---|---|---|
| DE | 3 45 276 C2 | 1/1994 |
| EP | 0 341 425 A2 | 11/1989 |
| EP | 0 550 828 A1 | 7/1993 |

* cited by examiner

*Primary Examiner* — Leslie A Nicholson, III
(74) *Attorney, Agent, or Firm* — Rankin, Hill & Clark LLP

(57) ABSTRACT

The invention relates to a processing device for processing printed products, in particular for collecting individual printed sheets for manufacturing an assembled printed product. The device includes a drum rotatable about a rotation axis and at least two feed stations arranged distanced from one another in the direction of the rotation axis, for feeding printed products, and at least one lead-away station for leading away processed printed products. The drum includes several guides, in particular saddle-like rests or conveyor compartments which are arranged in succession in the peripheral direction of the drum and are movable along a closed revolving path, as well as advance elements controlled by a control unit, for displacing the printed products in the direction of the rotation axis. For increasing the flexibility, the device is composed of modules.

18 Claims, 6 Drawing Sheets

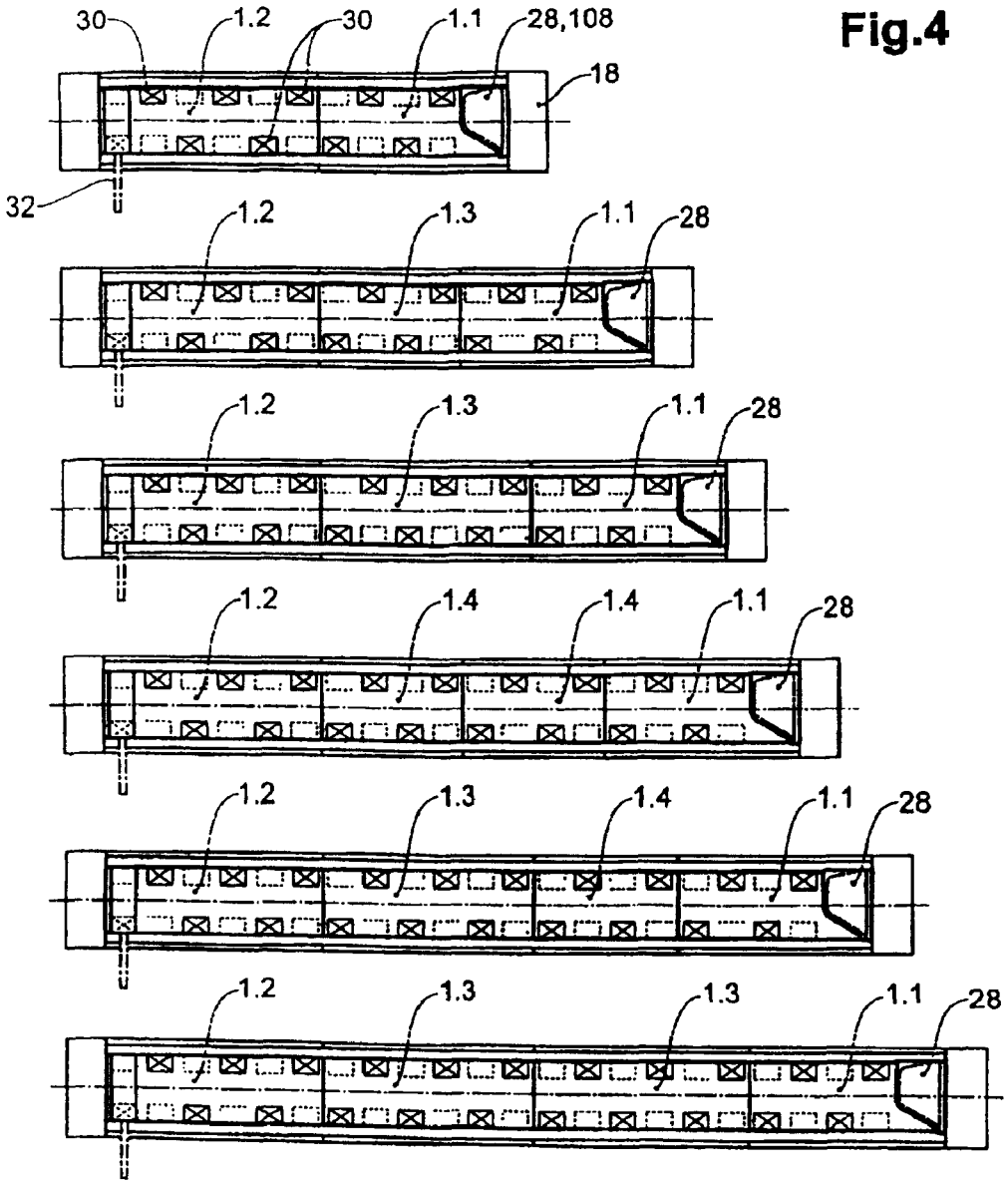
Fig.4
Fig.5
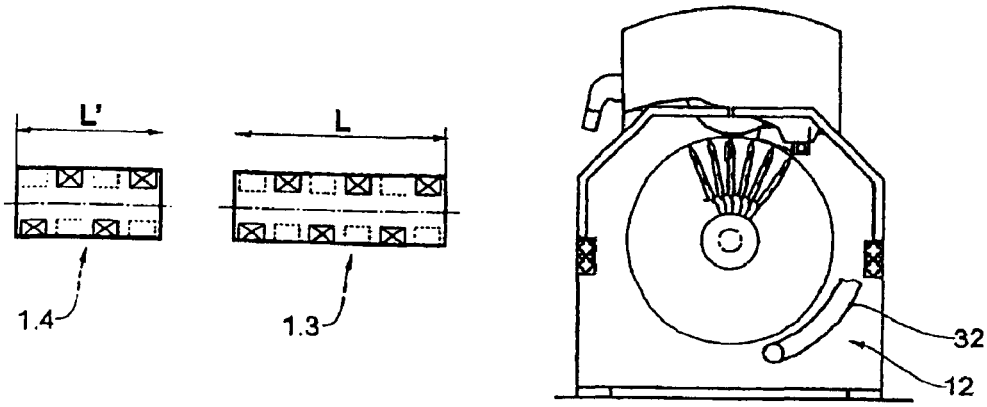

MODULAR PROCESSING DEVICE AS WELL AS A CONSTRUCTION KIT FOR THE CONSTRUCTION OF SUCH A PROCESSING DEVICE

BACKGROUND OF THE INVENTION

The invention lies in the field of processing and conveying printed products, and relates to a modular processing device, in particular to a so-called collector-stapler drum which for example is applied for manufacturing an assembled printed product by way of collecting individual printed sheets and subsequent stapling. The invention further relates to a construction kit for the construction of such a processing device.

The invention is based on processing drums, as are basically known e.g. from EP-A 0 341 425 or EP-A 0 550 828. A modular processing device is known from EP-A 0 341 425. The known devices serve for manufacturing a printed product assembled of folded printed sheets, e.g. a newspaper, brochure or magazine, and comprise a drum rotatable about a rotation axis, and at least two feed stations which are arranged distanced from one another in the direction of the rotation axis, for feeding the printed sheets, as well as a stapling and lead-away station for stapling and leading away the collected printed sheets. The drum comprises a drum shaft and several saddle-like rests, which delimit pocket-like receiver parts, and are arranged one after the other in the peripheral direction of the drum shaft and are able to be moved along a closed revolving path by way of rotation of the drum. The printed sheets coming from the feed stations are placed astride onto these rests. During a rotation of the drum, a printed sheet is transported along in each case one rest, i.e. in the direction of the rotation axis, from one feed station to the next feed station, where a further printed sheet is placed astride onto it. The printed sheets, thus, describe an essentially spiral-like path around the drum. The finished product is removed and conveyed away by a lead-away station arranged in an end region of the drum. Optionally, a stapling assembly may be arranged in front of the lead-away station, in order to staple together the individual sheets. Advance elements which revolve with the rests, serve for the transport of the deposited printed sheets in the axial direction, wherein, for example, one or more advance elements are allocated to each rest. The advance elements are periodically controlled such that they firmly clamp the printed sheet halves of the printed sheets, which are deposited onto the rests, against the rests, displace them in the axial direction during a forward travel, let go of them again, and return back into their initial position without gripping a printed product. A control unit which typically comprises a control link cooperating with the advance elements and effecting the forwards travel and backwards travel of the advance elements during the rotation of the drum, is provided for controlling the advance elements.

With such collecting devices, the number of the feed stations as a rule is set in a fixed manner and is limited by the length of the drum. A later extension of the device by further feed stations is not possible. It has already been mentioned in EP-A 0 341 425 that the collection drums can be composed of sections, in order to provide a collection drum with the suitable length, depending on the number of operations carried out. A basic section should, for example, have the width of three processing stations—two in-conveyors and two out-conveyors. Further sections should have the width of one or two feed stations. Further details with regard to the design of the modules and with regard to the type of coupling may, however, not be deduced from EP-A 0 341 425.

Since such collection drums have a length of several meters, it is important for the drum shaft to be stable with regard to any sagging. Moreover, the drum should have a certain twist rigidity, so that the rests remain straight and the products are capable of being led precisely in the axial direction. With a drum constructed in a modular manner, increased demands with regard to the stability exist, particularly at the interface locations between two modules.

It is therefore an object of the invention to further develop the concept known from EP-A 0 341 425. In particular, a modularly constructed processing device for printed products is to be provided, which is simple with regard to design and meets the increased stability requirements.

BRIEF SUMMARY OF THE INVENTION

The object is achieved by a modular processing device with a drum rotatable about a rotation axis, at least two feed stations arranged distanced from one another in the direction of the rotation axis, for feeding printed products; and at least one lead-away station for leading away processed printed products. The drum comprises several guides, which are arranged, one after another, in the peripheral direction of the drum and are movable along a closed revolving path. The drum further comprises advance elements controllable by a control unit, for displacing the printed products in the direction of the rotation axis. According to the invention, the device comprises at least two modules, wherein the modules comprise a base body rotatable about the rotation axis, guide sections and advance elements arranged on said base body, and support elements arranged in axial end regions of the base body projecting from the base body perpendicularly to the rotation axis, wherein the support elements are configured such that two support elements of adjacent modules are coupled or may be coupled to one another.

The object is further achieved by a construction kit for the construction of such a modular processing device, including at least two modules as described above.

The processing device which is basically constructed as previously described, according to the invention is constructed of several modules which may be manufactured independently of one another and are coupled or may be coupled to one another in the axial direction. The modules can be considered as functionally and mechanically autonomous/independent units that can be combined almost arbitrarily in the manner of a unit assembly system to form the processing device. The modules comprise the necessary components for supporting and advancing the products, and preferably also comprise the feed and/or lead-away stations, or are adapted to be coupled therewith after assembly of the drum.

The modules, in each case, include a base body which gives the module the required stability. In particular, several base bodies are coupled together and constitute the drum shaft of the complete device. The base body e.g. has the shape of a tube or cylinder and is preferably rotationally symmetrical. Guide sections, e.g. in the form of saddle-like rests for receiving folded products and/or pockets for the insertion of folded or unfolded products, are arranged on the base body. The guide sections form the initially described guides of the assembled device. The guide sections are arranged one after the other in the peripheral direction of the base body, and are moved along a closed revolving path on rotation of the base body. Moreover, each module comprises advance elements, with which the products may be displaced in the axial direction over a certain distance. Preferably, the stroke of the advance elements is such that the products are moved at least from one feed station to the next, so that the products describe a spiral-like path or similar path, winding around the drum. The advance elements, for example, have the form of carriages provided with one or more clamping elements, as described in EP-A 0 341 425. The advance elements of two or more modules, in an assembled device, are preferably coupled or may be coupled to one another such that they may be controlled with a common control device. The control device is preferably spatially assigned to one of the modules.

According to the invention, the base body in its axial end regions as seen in the axial direction, has support elements which project outwards perpendicularly to the rotation axis. These support elements are in each case directly or indirectly coupled or able to be coupled to a support element of an adjacent module. Since they project radially outwards beyond the outer surface of the base body, they improve the stability of the base bodies of the modular device when coupled to one another, with regard to the bending rigidity as well as the twist rigidity. This is particularly the case if two support elements are directly adjacent one another and are rigidly connected to one another.

In a further preferred variant of the invention, the support elements have the shape of a disk or flange or wheel. In particular, this disk or flange or wheel has a radius which is significantly larger than the radius of the base body, e.g. more than double the size. Apart from the stabilisation of the drum shaft against sagging and twisting, the support elements in a further advantageous formation of the invention serve for anchoring the guide sections, i.e. the rests or pockets or their sections, which run in the axial direction. The radius of the support elements may therefore correspond to the radius of the base body plus the width of the support elements measured in the radial direction, which increases the stability. For this, the support elements are advantageously formed as spoke wheels, so that the products may be led from one module to the next between the spokes without any hindrance. The guide sections thereby are arranged on their respective base body and in each case two modules are connected to one another, such that in each case two guide surfaces are in alignment with one another. The guide sections together with the support wheels, form a guide surface which is continuous in the axial direction, along which the products are guided. An additional coupling element for coupling the guide sections per se is therefore not absolutely necessary, but is possible.

The support elements of all modules are preferably essentially equal with regard to construction, so that interfaces which are essentially equal with regard to their construction are formed. Also two types of interfaces may be provided, which fit together according to the key-lock principle. A particularly large degree of flexibility, as well as a simple design, is achieved by way of this.

In a preferred variant of the invention, at least two different base modules are present, which are applied as end-pieces of the device. The first module comprises a control device in addition to the already described features. This control device serves for controlling the advance elements of at least two modules, which are coupled to one another in a suitable manner. A second module in addition to the features described above, includes a stapling and lead-away station, or may be coupled to such a station. All modules may also include feed stations or may be coupled thereto. Alternatively or additionally, feed stations may be arranged on further modules. Such intermediate modules are basically constructed as previously described and may be arranged between the first and the second module, which is why they have two interfaces.

Preferably, all modules have the same length or a length which corresponds to a uniform length or a multiple thereof.

In a further preferred embodiment, the stability of the complete device is additionally improved by way of holding devices, e.g. in the form of support belts, which support the drum assembled from the modules, from below, and in particular are arranged at the interfaces between two modules. By way of a suitable control of the advance elements, one ensures that the paths of the products do not run in those regions in which the holding device supports the drum. Product holding devices may be located offset from the holding devices for the drum in the axial direction and e.g. may likewise be designed as support belts. They prevent the products from falling out in the lower regions of the movement path of the guides. It is not necessary for the product holding devices to accommodate the weight of the actual drum; they may therefore be designed in a relatively lightweight manner, and have a simple design.

The construction kit according to the invention serves for the construction of a modular processing device for processing printed products, in particular of a collector stapler (stitcher) drum as is described in EP-A 0 341 425 or EP-A 0 550 828. It includes modules of the type mentioned above, which may be coupled to one another with an improved stability.

The invention has the advantage that individual modules may be manufactured, stored and transported, instead of a single-piece, long processing drum. By way of this, it becomes possible to simplify the delivery and to shorten the assembly times at the location of application. Moreover, the storage is simplified, since from now on, one only needs to have individual modules available, which may be flexibly combined into differently configured devices, instead of different variants of the device. Well defined interfaces of the individual modules allow combination of each module with any other one by a simple mechanical operation, and without the need to modify the components after putting together the modules (except, possibly, for mounting stations like the feed/lead-away stations). No long parts have to be handled and stabilised. Finally, an extension or supplementing of an existing processing drum is simply possible. The flexibility is also increased by way of arranging a module with an additional lead-away station with a stapling function, between two existing modules. This variant permits a parallel operation of the processing device in individual modules or groups of modules.

Instead of being collected, i.e. being applied astride on one another in the folded condition, the device may serve for collating the sheets or inserting them into one another. Mixed forms of these processing processes are also possible. The device may for example also be an insert drum.

BRIEF DESCRIPTION OF THE DRAWINGS

Examples of the invention are presented in the drawings and are described hereinafter. In a purely schematic manner, there are shown in:

FIG. 4 different examples of a modular processing device and individual modules;

FIG. 5 a lateral view of the processing device in the direction of the rotation axis, for representing a lead-away station with a stapling assembly;

DETAILED DESCRIPTION OF THE INVENTION

Figure 1:
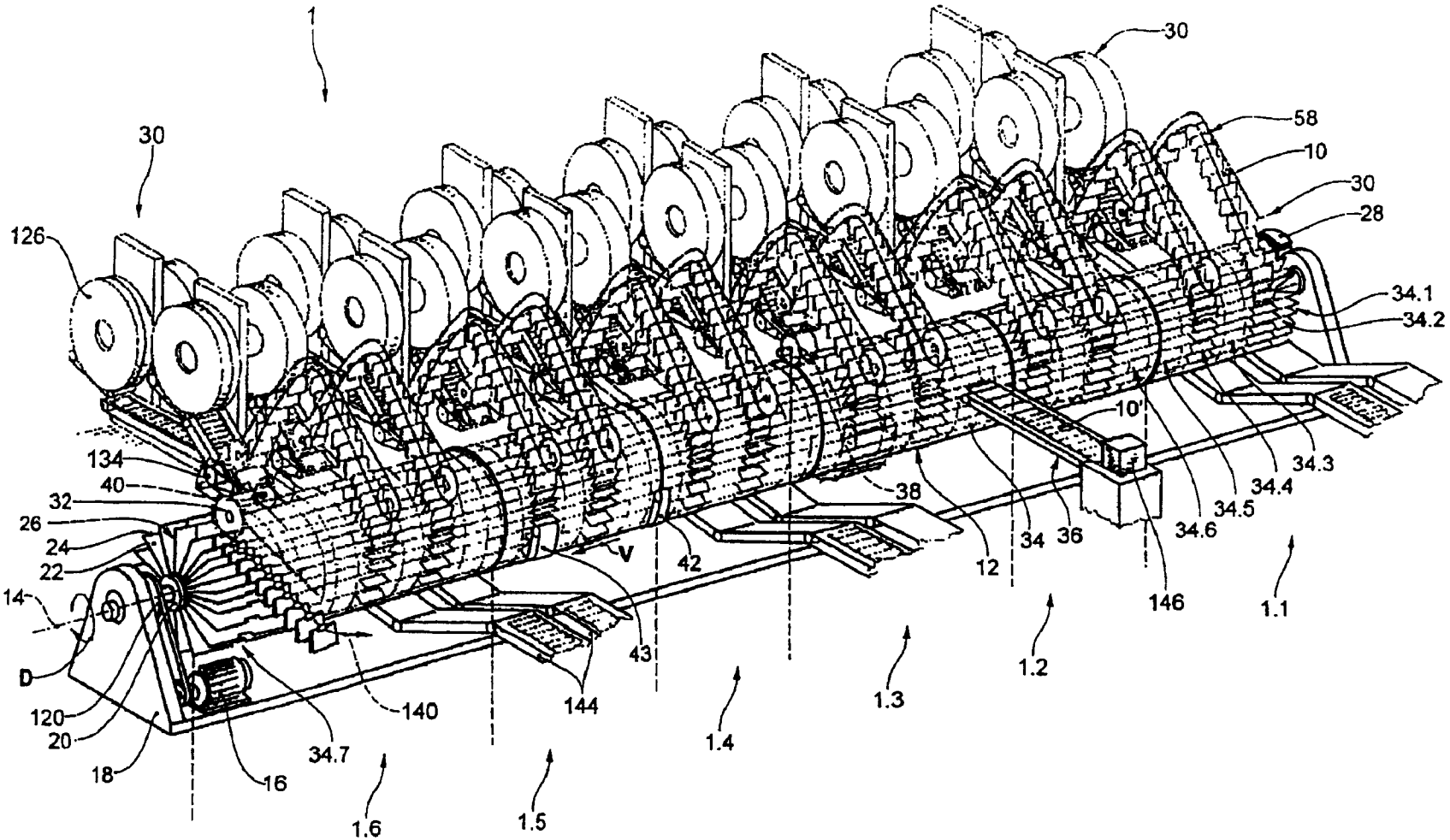
FIG. 1 an overview representation of the processing device according to the invention.

The device for processing printed products 10 shown in FIG. 1, with regard to its basic construction or its basic function, corresponds to the device shown in EP-A 0 550 848 in FIG. 1. Differences exist in the inventive modular form of the processing drum 12, as well as in the holding devices 42 for the drum. For this reason, this document is supplementarily referred to with regard to the exact design and function of the device 1 and its elements.

Figure 3D:
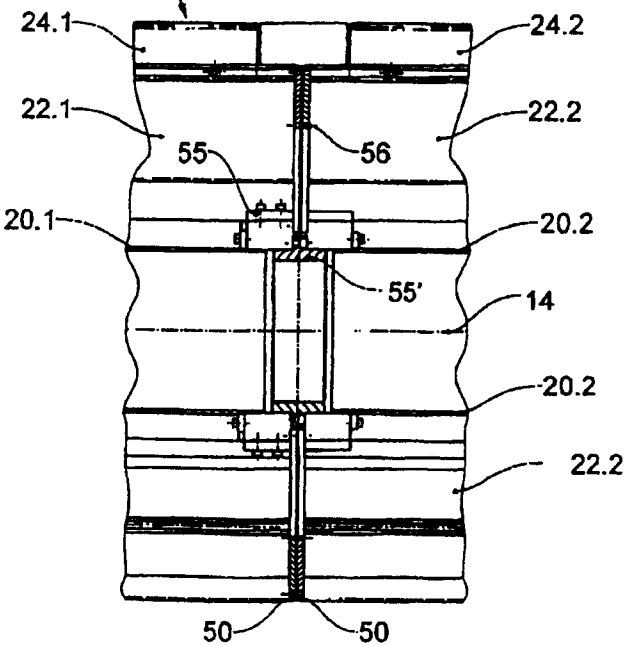
FIG. 3*a-d* different views of a module or the interface between two modules.
Figure 3C:
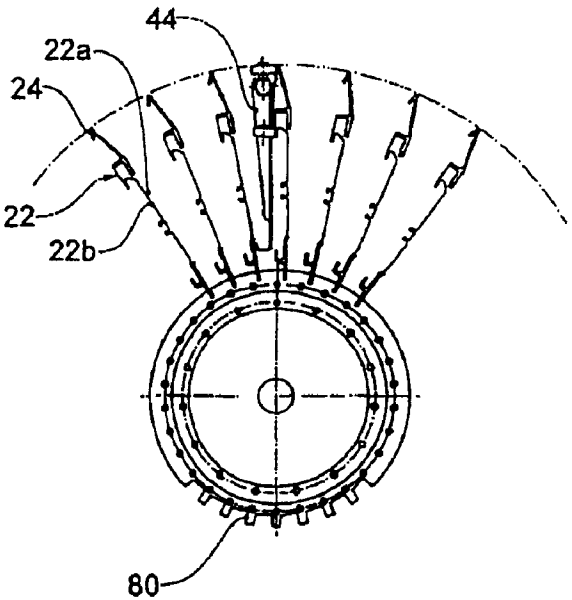
Figure 3B:
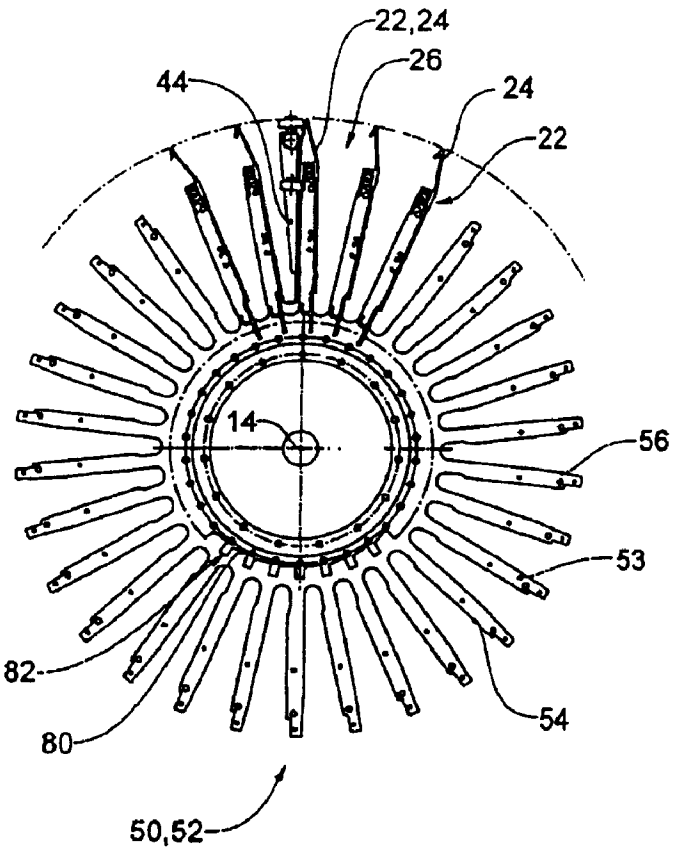

The device 1 comprises an elongate processing drum 12, which is rotatably mounted about its horizontal axis 14 and is driven in the rotation axis D by way of a drive motor 16. A multitude of lamella-like wall elements or guides 22, which extend over the complete processing-active length of the processing drum 12 and, seen in the peripheral direction, are uniformly distributed, and are fasted on the drum shaft 20 which is rotatably mounted on a machine frame 18. As is described further below and is shown in FIGS. 3*b*, 3*c*, the guides 22 in their radial end regions comprise saddle-like rests 24 which run parallel to the axis 14. In each case, two adjacent guides 22 delimit a pocket-like receiver part 26, into which advance elements 44 which are not shown in FIG. 1 (see FIGS. 3*b*+*c*) project, in order to advance the printed products 10 deposited astride onto the rests 24, or the printed products 10' introduced into the receiver parts 26, along the rests 24 or guides 22 respectively in steps in the advance direction V. The advance elements, in the course of one revolution of the processing drum 12, and controlled by a control device 28, e.g. a link control, in each case execute a working travel (displacement) in the advance direction V, and thereby take with them the printed products 10, 10' by one step, and a return travel opposite to the advance direction V without at the same time influencing the printed products 10, 10'.

Twelve feed stations 30 are arranged next to one another along the processing drum. Seen in the advance direction V, a lead-away station 32 is arranged after these feed stations 30. The feed stations 30 here are designed to feed folded printed products 10 to the processing drum 12 and to deposit them astride on their rests 24 or onto printed products already deposited onto these, in the known way and manner. In the present case, products 10 intermediately stored on a roll 126 are wound off and are supplied in a manner known per se by way of a transfer device 134 of the known construction type. The feed stations 30 could however also be designed such that they insert folded or unfolded printed products into the receiver parts 26. Here, such printed products 10' are optionally fed by way of further feed stations in the form of a conveyor belt 144 or a feeder 146. The lead-away station 32 is provided for taking over the printed products 10, 10' processed into a finished product, from the processing drum 12, and leading them away, e.g. by way of a gripper conveyor 140.

The processing drum 12 may be divided functionally into drum sections 34.1, 34.2, . . . , 34.7 of equal width, which are directly successive in the axial direction, wherein this width may be slightly smaller than the working travel of the advance elements, but corresponds to a step by which the printed products 10, 10' are advanced in each case. The control device 28 for the advance elements is provided in the region of a drum section which is indicated at 34.1 and which is the first one seen in the advance direction V. A first feed station 30 is assigned to the adjacent drum section 34.2 which follows next in the advance direction V. In the shown embodiment example, apart from an axial conveying, no processing of the printed products 10 supplied in the second drum section 34.2 takes place in the next drum section 34.3, and in the further sections, further printed products 10 are deposited astride onto the printed products 10 which have already been deposited onto the rests 24. Other types of processing stations may also be assigned to the drum sections 34, as is shown in FIG. 1 by way of a device 36 for introducing printed products 10' (attachments), a schematically indicated device 38 for gluing attachments onto the respective printed products 10, and a likewise schematically indicated stapling device 40 for stapling together the collected printed products 10.

According to the invention, the device 1 is physically divided into individual modules 1.1, 1.2, 1.3, . . . , 1.6, which are manufactured individually and are assembled into the complete device. As shown in the FIGS. 2, 3*a*, 3*d*, 4 and 5, the modules first and foremost are formed by a segmentation of the drum 12. The boundaries between the modules are indicated here by way of unbroken lines. A module 1.1, 1.2, 1.3, . . . , 1.6 in particular has a multiple of the width of a drum section 34, 34.1, . . . , 34.7. The shape of the interfaces between the modules 1.1, 1.2, 1.3, . . . , 1.6 amongst other things, is described with reference to FIGS. 2, 3*a-d*.

Preferably, the device 1 comprises holding devices 42, 43, which grip around the processing drum 12 from below roughly in the region of its lower halves. Drum holding devices 42 serving to stabilise the drum 12 are in particular arranged at the connection locations of two modules 1.1, 1.2, 1.3, . . . , 1.6. Product holding devices 43 are arranged distanced thereto in the axial direction, and these prevent the printed products 10, 10' from falling down from the rests 24 or out of the receiver parts 26, when, together with the rests 24 and receiver parts 26, they run through the lower half of the revolving path about the axis 14. In each case, only one drum holding device 42 and product holding device 43 is indicated in FIG. 1, for the purpose of a better overview.

The manner of functioning of the device shown in FIG. 1 is described below. The conveyors 58 of the feed station 30 which is the first one seen in the advance direction V, supply a printed product 10 in the feed section 34.2 of each rest 24, so that this printed product comes to lie astride on the rest 24. The deposited printed products 10 maintain their position with respect to the rests 24 on rotation of the processing drum 12 in the rotation direction D, until the advance elements 44 in each case execute a working travel. This is effected in the rear upper quadrant of the processing drum 12 which is not visible in FIG. 1. Thereby, the printed products 10 get into the drum section 34.3 where no processing is effected. In the course of the next revolution, the printed products 10 are led from this feed section 34.3 to the feed section 34.4, where now a further printed product 10 is deposited astride onto each printed product 10 by the respective conveyer 58. These two printed products 10 which are deposited on one another, in the course of three further revolutions of the processing drum 12, are moved step-by step to the feed section assigned to the feed station 30 which follows next, where again a further printed product 10 is deposited astride thereon. The printed products 10 in this manner are moved step-by-step, in the course of each revolution, to a subsequent drum section 34, where a further processing of the printed products 10 may or may not take place. The finished products are taken over by the gripper conveyor 140 and led away when the finished, processed printed products 10 reach the feed section 34.7 at the end of the processing drum 12.

Figure 2:
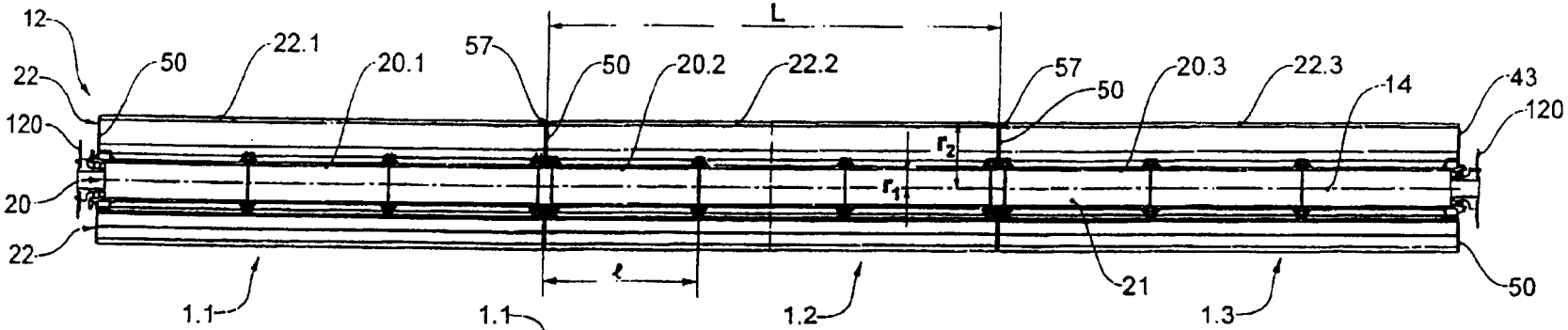
FIG. 2 a processing device which is constructed of three modules.
Figure 3A:
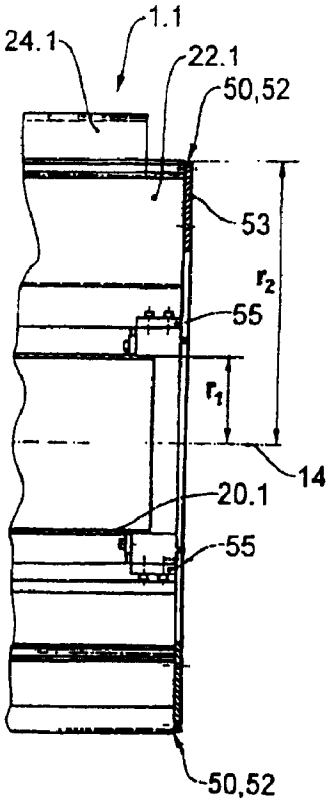

FIG. 2 shows a processing drum 12 constructed of three individual modules 11, 1.2, 1.3. FIG. 3*a-d* show detailed views of this processing drum or its modules; FIG. 3*a* shows a view of an end region of the module 1.2, which is partly sectioned along the rotation axis 14, for the representation of the interface; FIG. 3*b* shows a front view onto such an interface or onto the support element 50; FIG. 3*c* shows a section perpendicular to the rotation axis 14 on the remote side of the support element for representing the support elements 22, and FIG. 3*d* shows the border region of two modules 1.1, 1.2 coupled to one another.

According to FIG. 2, the drum shaft 20 which is of one piece with EP-A 0 550 828, according to the invention, is subdivided into at least three sections 20.1, 20.2, 20.3. These tubular drum shaft sections correspond to the base body of a module 1.1, 1.2, 1.3. The modules may yet comprise one or more feed stations or lead-away stations, which are not shown in FIGS. 2, 3*a-d*.

Here, the modules 1.1, 1.2, 1.3 each have the same length L. The base bodies 20.1, 20.2, 20.3 here are further subdivided, and specifically in each case into three segments 21 which are coupled to one another and which preferably have a uniform length l. The module length L corresponds to a threefold of the length of the tube segments 21 plus the length of a coupling piece 55'. L for example corresponds to the width of four or six sections 34. Also, only two segments 21 may be connected to one another, to manufacture a module of a shorter length (see e.g. module 1.4 in FIG. 4).

According to the invention, the base bodies 20.1, 20.2, 20.3 at their axial end regions comprise support elements 50 projecting radially outwards from the rotation axis 14 beyond the base bodies 20.1, 20.2, 20.3. As shown in FIG. 3*a*, the radius r2 of the support element 50 is significantly larger, preferably 1.5-times to 3-times larger, than the radius r1 of the base body. The support elements 50, for example, have the form of spoked wheels 52, as is shown in more detail in FIG. 3*b*. The support elements 50 have a front surface 53 which runs perpendicularly to the rotation axis 14 (see FIGS. 3*a+b*), and which terminates in the axial direction flush with the base body (not shown here) or projects beyond this (FIG. 3*a*), so that in each case two front surfaces 53 bear on one another and may be directly connected to one another, e.g. screwed, when in use. The connection locations 56 of two support elements 50, indicated by bores in FIGS. 3*b* and 3*d*, preferably lie outside the radius r1 in the radially outwardly lying regions of the support element 50, for increasing the twist rigidity.

The support elements 50 are rigidly connected to the end regions of the base bodies 20.1, 20.2, 20.3 by way of suitable coupling elements 55. Since the support elements 50 here project beyond the base bodies 20.1, 20.2, 20.3 in the axial direction, in each case a further coupling piece 55' (FIG. 3*d*) which is rigidly connected to the coupling elements 55 and here has the shape of a tube piece with roughly the same radius as the base bodies 20.1, 20.2, 20.3 as well as a flange projecting outwards in the axial direction, is located between two base bodies 20.1, 20.2, 20.3 in each case. The support elements 50 and the coupling piece 55' or base body 20.1, 20.2, 20.3 and the coupling piece 55' may also be of one piece.

The modules 1.1, 1.2, 1.3 comprise guide sections 22.1, 22.2, 22.3 which are arranged on the base body 20.1, 20.2, 20.3 and which are coupled into a guide 22 of the device 1, which is continuous in the axial direction. These guide sections 22.1, 22.2, 22.3 are anchored in their end regions to the support elements 50. A twisting of the guides is also counteracted with large total lengths of the drum 12 by way of this.

As FIG. 2 shows, such support elements which serve for anchoring the guide sections 22.1, 22.2 of the respective module, are arranged at the respective outwardly lying end regions of the complete device which are not connected to a further module. These end regions have a coupling 120 via which the drum shaft 12 is connected to the drive 16 and/or is mounted in the frame 18.

The guide sections 22.1, 22.2, 22.3 have the shape of profiled sheet metal with an essentially straight guide surface 22*a* and with a rear surface 22*b* provided with notches. The notches or the complete rear surface 22*b* serve as guides for the advance elements 44. These are indicated in FIGS. 3*b* and 3*c*. EP-A 0 550 828 is referred to for a more detailed explanation of the construction and the function of the advance elements 44 and its control. Since the advance elements 44 only execute a certain travel, which is smaller than the distance of two support elements 50, their movement is not prevented by the support elements 50. The advance elements 44 of two adjacent modules 1.1, 1.2 which in each case are assigned to a common receiver part 26, are coupled to one another by way of suitable means which e.g. engage over the support elements 50, e.g. by way of rods. By way of this, they may be driven by way of a common drive and be controlled by way of a common control device, as with the device which is not subdivided, e.g. according to EP-A 0 550 828.

The spoked wheel 52, seen in the axial direction, has a straight front surface and rear surface, and an axial extension which is small compared to the length L of the module. The spoked wheel 52 in the peripheral direction comprises the same number of spokes 54 as the drum 12 has support elements 22. The notches between the spokes 54 serve for the unhindered passage of the printed products 10, 10' along the guide sections 22.1, 22.2, 22.3.

The sections 24.1, 24.2 of the rest 24 described above, are here formed of a bent profile sheet metal, which is placed onto the guide sections 22.1, 22.2, 22.3, but may also be designed as one piece with these. The guide sections 22.1, 22.2, 22.3, at their ends which face the rotation axis 14, are located in grooves 80 in the drum shaft 12 or its sections 12.1, 12.2 which are located over the whole length of the drum shaft 12 or the respective section, or are located only in the region of the spoke wheel 52. The guide sections 22.1, 22.2, 22.3 at their end regions which lie to the outside in the axial direction, are anchored on the spokes 54 of the spoke wheel 52. For this, these have a shape which is essentially complementary to the profile of the rear surface 22 of the guide sections 22.1, 22.2, 22.3, as is shown in FIG. 3*b*.

The width of the guide sections 22.1, 22.2, 22.3, measured in the radial direction, corresponds roughly to the difference of the radii r1 and r2. However, it is also possible for the guide sections 22.1, 22.2, 22.3 or the rest sections 24.1, 24.3 placed thereon, to project radially beyond the support elements 50. In this case, the radially outwardly lying surfaces of the guide sections 22.1, 22.2, 22.3 or the deposited rest sections 24.1, 24.3, are preferably connected to one another by way of connections elements 57. By way of this, the stability is additionally increased and a shoulder-less, continuous guide surface or guide edge of the guides 22 is created.

FIG. 3*c* shows a section through a module in a middle region, i.e. on the side distant to the support elements 50. Here, the construction corresponds to a non-modular device, e.g. according to EP-A 0 550 828. Only a few guide sections 22.1, 22.2, 22.3 and only one advance elements 44 are shown, for the purpose of a better overview.

FIG. 4 shows several variants of a device constructed of different modules. All variants comprise a first module 1.1 as well as a second module 1.2. Both modules are basically constructed as described with reference to FIGS. 2, 3*a-d*, and have roughly the same length L measured in the axial direction. In its end regions, the device 1 is mounted on a machine frame 18. The device is supported outside the end regions by holding devices which are not shown here.

The first module 1.1 which is arranged here in each case in the right end region of the device, comprises a control device 28 for the advance elements 44. This preferably comprises a link control 108 which here is only indicated schematically, in particular as described in EP-A 0 550 828. The advance elements 44 of all modules 1.1, 1.2 are coupled to one another and may therefore be controlled by the same control device 28. In particular, they execute a synchronous travel movement in the axial direction as well as a synchronous clamping movement in the peripheral direction.

The first module 1.1 is furthermore coupled to four feed stations 30, which here are illustrated only schematically, however e.g. are described in more detail in EP-A 0 550 828.

The second module 1.2, which here in each case is arranged in the left end region of the device, comprises a lead-away station 32 which is likewise only shown in a schematic manner. It has roughly the same width as a feed station 30, of which the second module 1.2 has five. The lead-away station 32 is arranged below the drum 12, as sketched in FIG. 5. It comprises a stapler device, for example.

The device which is composed of these base elements 1.1, 1.2 may be supplemented by further modules 1.3, 1.4. Two different intermediate module types are sketched in the right part of FIG. 4. A first intermediate module 1.3 has six feed stations 30 and a total length L which corresponds to the length of a base element 1.1. A second intermediate module 1.4 has only four feed stations 30 and a correspondingly reduced total length L', which is about ⅔ of the length L. One, two or more of these intermediate modules 1.3, 1.4 may be arranged between the base modules 1.1, 1.2, depending on the demands on the assembled printed product to be manufactured. FIG. 4 shows different examples for devices with in total 9, 13, 15, 17, 19 and 21 feed stations. The construction kit system permits a simple extension of existing devices thanks to the uniform interfaces of the modules. According to the invention, one is also able to create the required stability.

Figure 6:
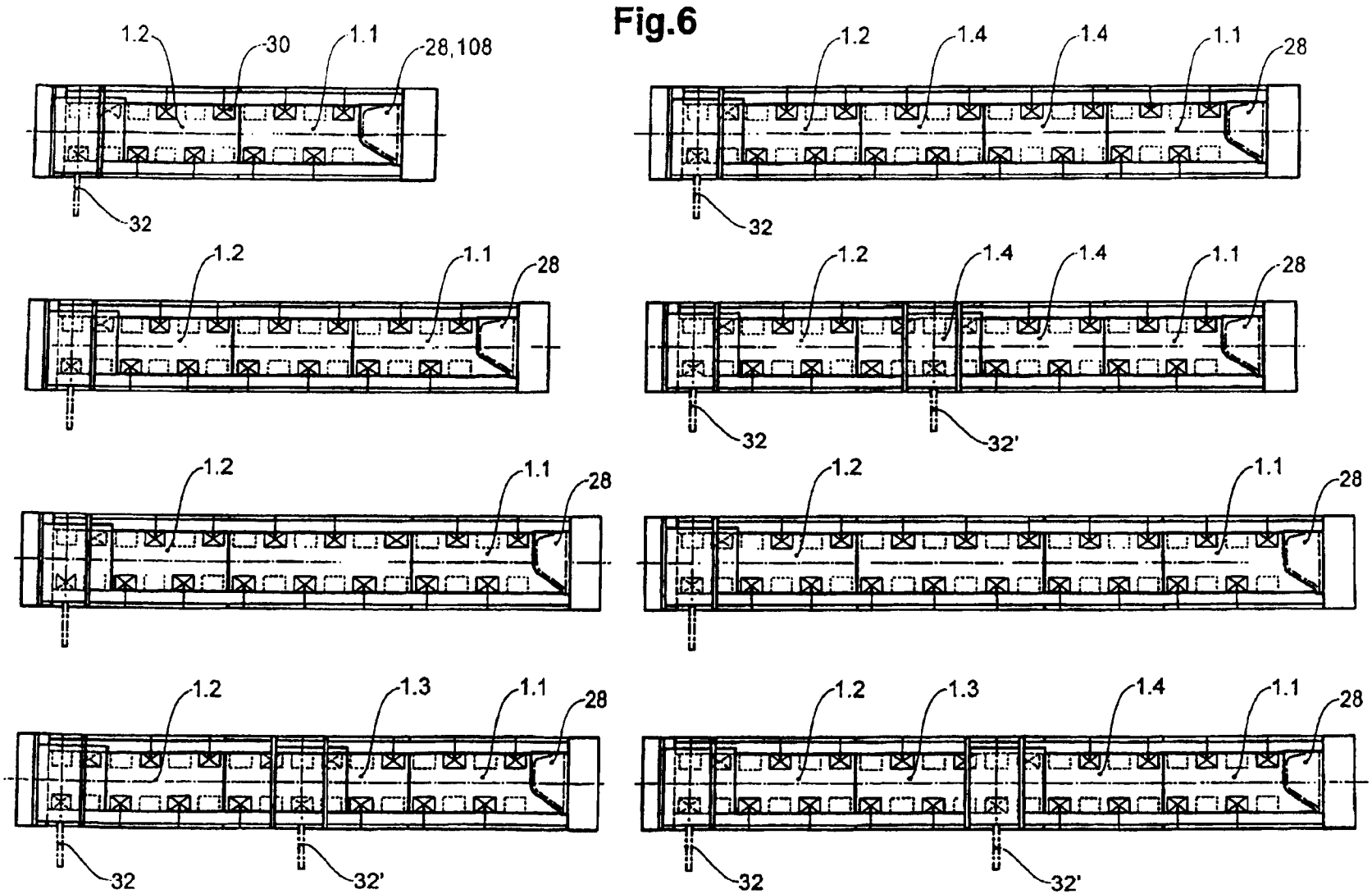
FIG. 6 different examples for modular processing devices with one or two lead-away stations, in each case with a stapling assembly.

FIG. 6 shows an overview of different devices assembled from modules, wherein here, in each case the lead-away station 32 with a stapling assembly sketched in FIG. 5 is indicated. The devices basically do not differ from those of FIG. 4, with two exceptions outlined hereinafter.

Two of the devices, next to the lead-away station 32 with a stapling assembly, which is arranged in the left end region, comprise a further lead-away station 32' with a stapling assembly, which is equal with regard to its construction. This further lead-away station is located in the middle of an intermediate module 1.3 (left part of FIG. 6) or at the beginning of the intermediate module (right part of FIG. 6). For this reason, the respective devices for this reason may be applied for assembling two products independent of one another, in parallel. The respective assembled end products, which consist in each case of 6 or 8 part products, are removed at the two lead-away stations 32, 32'. Instead of independent products, one may also manufacture identical products with the two part devices, and these may be removed at the lead-away stations 32, 32', in order, thus, to achieve a double output. If required, the further lead-away station 32' may however also be deactivated, in order to manufacture an end product consisting of 11 or 15 part products, by way of a series arrangement of all present feed stations 30.

Figure 7:
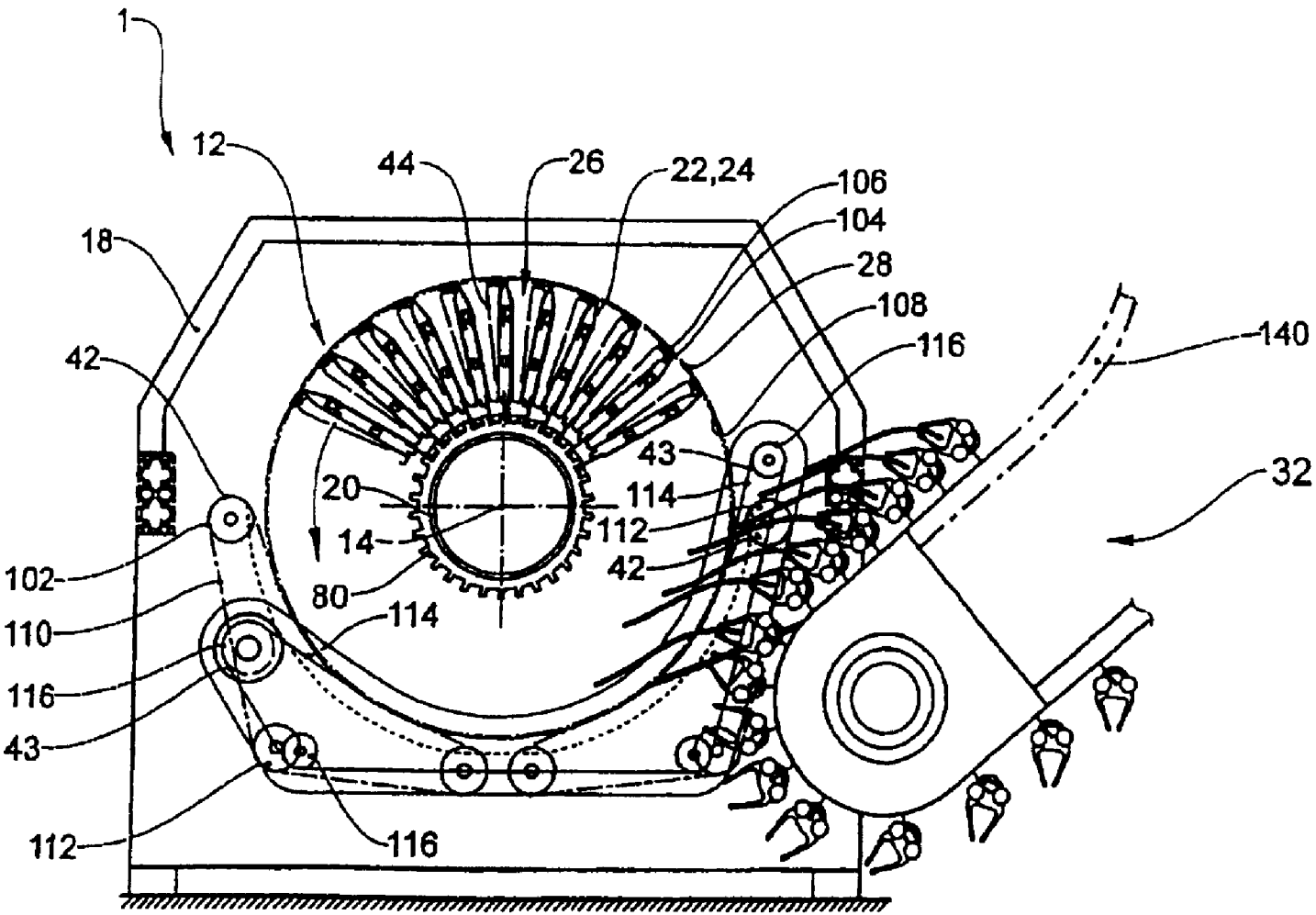
FIG. 7 a lateral view of the processing device in the direction of the rotation axis, for representing an alternative lead-away station.

FIG. 7 shows a partly sectioned view of a device 1 according to the invention, in the direction of the rotation axis 14. One may recognise the drum 12 with the drum shaft 20 and radially projecting guides 22 which are arranged thereon and which form guide surfaces or pocket-like receiver parts 26, which are continuous in the axial direction. The modular construction of the device as well as the support elements 50 according to the invention, are not visible in this representation. Holding devices 42 for the actual drum 12, and holding devices 43 which prevent the products from falling out of the receiver parts 26, are located below the drum. The drum 12 and these holding devices 42, 43 are located in a machine frame 18. This has a passage for a lead-away station 32, which here comprises a gripper conveyor 140.

Advance elements 44, as described above, run on the profiled rear side of the guides 22 in the axial direction. Levers 104 which are moved together with the drum 12 or in each case with a receiver part 26, are located in the first module 1.1 in the region of the control device 28, i.e. in an end region of the device. These levers are directly coupled to the respective advance elements 44 of the first module 1.1. The advance elements 44 of the remaining modules have no such levers 104. However, an indirect coupling of these advance elements to the lever 104 exists by way of coupling the advance elements 44 of adjacent modules 1.1, 1.2, . . . amongst one another.

The lever 104 at its radially outwardly lying end has a control roller 106 which projects beyond the respective receivers 24. It cooperates with a link arrangement 108, which is led around the axially outwardly lying end region of the first module 1.1, in a casing-like manner, and is part of the control device. The travel movement of the advance elements 44 is caused by way of a suitable shape of the link arrangement 108. Details of the control and the advance elements may be deduced from the already mentioned documents EP-A 0 341 425 and EP-A 0 550 828.

The holding devices 42 for the drum 12 comprise a support belt 110 which is led over several revolving rollers 12, such that its belt face facing the drum 12 roughly supports the lower third of the drum. Sagging is prevented by way of this. The support belt 110 preferably has an unstructured surface. Problems with regard to the synchronisation of the rests and of any revolvingly moved holding elements adapted thereto, are avoided by way of this. These may for example occur with the holding device described in EP-A 0 550 828, with which the holding elements which are V-shaped in cross section, engage around the rests and support them by way of this.

The holding device 42 for the drum is preferably arranged in the vicinity of the interface between two modules. The control device 28 is configured such that the products are located in the regions of the interfaces in the upper half of the revolving path or the drum 12. The support belt 110 of the holding device does not therefore come into contact with the products. Thus, there is no danger that these are damaged between the drum 12 and the support belt 110.

Holding devices 43 for the products are arranged laterally of the drum holding device 42 in the regions. It likewise comprises a support belt 114 which revolves over deflection rollers 116, and in the lower drum half bears on the rests 24 or closes the receiver parts 26. The support belt 114 here does not need to exert a large force onto the drum 12, since only the weight force of the products needs to be accommodated, in order to prevent these from falling out.

The described functional subdivision of the holding devices 42, 43 into holding devices for the drum and holding devices for the products and their spatial separation, has the advantage that the drum as well as the products may be supported in a simple and safe manner—specifically with one support belt—without mechanically compromising the products. This concept may advantageously also be applied with device having no modular design.

The invention claimed is:

1. A processing device for processing printed products, in particular for collecting individual printed sheets for manufacturing an assembled and stapled printed product, comprising:

a drum rotatable about a rotation axis;

at least two feed stations arranged distanced from one another in the direction of the rotation axis, for feeding printed products;

at least one lead-away station for leading away processed printed products, wherein the drum comprises several guides, which are arranged one after another in the peripheral direction of the drum and are movable along a closed revolving path, and wherein the drum comprises advance elements controllable by a control unit, for displacing the printed products in the direction of the rotation axis;

wherein the device comprises at least two modules, and wherein the modules comprise:

a base body rotatable about the rotation axis;

guide sections and said advance elements arranged on said base body;

support elements arranged in axial end regions of the base body, wherein the support elements are configured such that two support elements of adjacent modules are coupled or may be coupled to one another, wherein the support elements project as spokes radially outwards from the base body beyond the outer surface of the base body and perpendicular to the rotation axis and wherein the device with the support elements has the form of a spoked wheel as viewed in axial direction.

2. A processing device according to claim 1, wherein the guide sections extend over the length of the respective module, and are anchored on the support elements with their ends lying to the outside in the direction of the rotation axis.

3. A processing device according to claim 1, wherein the support elements project above the axial end regions of the base body as seen in the direction of the rotation axis.

4. A processing device according to claim 1, wherein the support elements of two adjacent modules bear directly on one another and are rigidly connected to one another.

5. A processing device according to claim 1, further comprising an interface constituted by an axial end region of a module, wherein the interfaces of all modules are essentially constructionally the same.

6. A processing device according to claim 1, wherein at least one first module is present, which comprises a control unit for controlling the advance elements of at least two modules, and wherein at least one second module is present, which comprises a stapling and lead-away station, or is in cooperation with a stapling and lead-away station.

7. A processing device according to claim 6, wherein at least one of the first and the second modules comprises at least one feed station or is in cooperation with at least one feed station.

8. A processing device according to claim 6, wherein at least one further stapling and lead-away station is present, which is arranged on the first module or on a further module.

9. A processing device according to claim 1, wherein coupling elements are present, with which the advance elements of at least two adjacent modules are coupled in a manner such that they may be controlled by a common control unit.

10. A processing device according to claim 1, wherein at least two feed stations and at least two stapling and lead-away stations are present.

11. A processing device according to claim 1, wherein the modules have the same number of feed stations.

12. A processing device according to claim 1, wherein the modules have essentially an integer multiple of a uniform length (l) as seen in the direction of the rotation axis.

13. A processing device according to claim 12, wherein the modules have essentially the same length.

14. A processing device according to claim 1, further comprising a holding device which supports the drum from below, in the border region between two modules.

15. A processing device according to claim 1, wherein the guide sections of adjacent modules are aligned flush with one another and form guides which are continuous in the axial direction.

16. A processing device according to claim 1, wherein the guides comprise at least one of saddle-like rests and conveyor compartments.

17. A construction kit for the construction of a modular processing device including a drum rotatable about a rotation axis, at least two feed stations arranged distanced from one another in the direction of the rotation axis, for feeding printed products, and at least one lead-away station for leading away processed printed products, the kit comprising at least two modules, wherein the modules comprise a base body rotatable about the rotation axis, guide sections and advance elements arranged on said base body, support elements arranged in axial end regions of the base body projecting from the base body perpendicularly to the rotation axis, wherein two support elements of adjacent modules are coupled or may be coupled to one another wherein the support elements project as spokes radially outwards from the base body beyond the outer surface of the base body and perpendicular to the rotation axis and wherein the device with the support elements has the form of a spoked wheel as viewed in axial direction.

18. A construction kit according to claim 17, wherein a first module comprises a control device for controlling the advance elements of at least two modules, and wherein a second module comprises a stapling and lead-away station or may be coupled to a stapling and lead-away station, and wherein at least one further module may be coupled to at least one of the first and second modules.

* * * * *